US009728114B2

(12) United States Patent
Sun

(10) Patent No.: US 9,728,114 B2
(45) Date of Patent: Aug. 8, 2017

(54) DISPLAY DRIVE SIGNAL COMPENSATING METHOD, DISPLAY DRIVE SIGNAL COMPENSATING DEVICE FOR CARRYING OUT SUCH METHOD, AND DISPLAY COMPRISING SUCH DEVICE

(71) Applicant: BOE TECHNOLOGY GROUP CO., LTD., Beijing (CN)

(72) Inventor: Tuo Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 174 days.

(21) Appl. No.: 14/316,252

(22) Filed: Jun. 26, 2014

(65) Prior Publication Data

US 2015/0302817 A1 Oct. 22, 2015

(30) Foreign Application Priority Data

Apr. 21, 2014 (CN) ..... 2014 1 0159260

(51) Int. Cl.
*G09G 3/20* (2006.01)

(52) U.S. Cl.
CPC ..... *G09G 3/20* (2013.01); *G09G 2320/0223* (2013.01); *G09G 2320/0233* (2013.01)

(58) Field of Classification Search
CPC ..... G09G 3/20; G09G 2320/0223; G09G 2320/0233

(Continued)

(56) References Cited

U.S. PATENT DOCUMENTS

2006/0139249 A1* 6/2006 Kang ..... G09G 3/22 345/75.2
2008/0266282 A1 10/2008 Lee et al.

(Continued)

FOREIGN PATENT DOCUMENTS

CN 1417761 A 5/2003
CN 101046936 A 10/2007

(Continued)

OTHER PUBLICATIONS

First Office Action issued by SIPO on Sep. 6, 2015 in corresponding Chinese Application No. 201410159260.3, with English translation, 7 pages.

*Primary Examiner* — Lisa Landis
(74) *Attorney, Agent, or Firm* — Kinney & Lange, P.A.

(57) ABSTRACT

The present invention relates to liquid crystal display manufacturing technology. There provides a display drive signal compensating method, comprising the steps of: acquiring an original drive signal of every row of input pixels in a display; determining a position of the row of input pixels, based on the original drive signal; generating a compensation signal for compensating the original drive signal, based on a transmission line internal resistance at the position of the row of input pixels; and outputting a superposed signal obtained by superposing the compensation signal on the original drive signal to the row of input pixels. This method can compensates a voltage drop of the drive signal resulted by the transmission line internal resistance and thus improves the display effect. Meanwhile, there also provide a display drive signal compensating device for carrying out the abovementioned method, and correspondingly, a display comprising such device.

7 Claims, 6 Drawing Sheets

(58) Field of Classification Search
USPC ..... 345/89
See application file for complete search history.

(56) References Cited

U.S. PATENT DOCUMENTS

| | | | | |
|---|---|---|---|---|
| 2012/0086694 | A1* | 4/2012 | Tseng | G09G 3/3233 345/212 |
| 2013/0235011 | A1* | 9/2013 | Lin | G09G 3/3648 345/211 |

FOREIGN PATENT DOCUMENTS

| | | | |
|---|---|---|---|
| CN | 102282602 | A | 12/2011 |
| CN | 102402963 | A | 4/2012 |
| CN | 102682732 | A | 9/2012 |
| CN | 102971782 | A | 3/2013 |
| KR | 20050005198 | A | 1/2005 |

* cited by examiner

DISPLAY DRIVE SIGNAL COMPENSATING METHOD, DISPLAY DRIVE SIGNAL COMPENSATING DEVICE FOR CARRYING OUT SUCH METHOD, AND DISPLAY COMPRISING SUCH DEVICE

CROSS-REFERENCE TO RELATED APPLICATION

This application claims the benefit of Chinese Patent Application No. 201410159260.3 filed on Apr. 21, 2014 in the State Intellectual Property Office of China, the whole disclosure of which is incorporated herein by reference.

BACKGROUND OF THE INVENTION

Field of the Invention

The present invention relate to liquid crystal display manufacturing technology, and more particularly, to a display drive signal compensating method, a display drive signal compensating device for carrying out the abovementioned method, and a display comprising such device.

Description of the Related Art

In a conventional Active Matrix/Organic Light Emitting Diode (AMOLED) panel, VDD from a direct current power supply is drawn to every pixel through transmission lines in the panel. Due to electric resistance existing in conductor of the transmission line (i.e., transmission line internal resistance), loss of voltage occurs during the transmission of VDD, such that VDDs obtained at these pixels in the panel are different from each other. Current driving is used in the AMOLED technology, and, the current through the pixel is obtained from the following equation:

$$I = \frac{C_{ox} \times \mu \times W}{L}(V_{DD} - V_{data})^2 \quad (1)$$

and, if loss of VDD is considered, the current through the pixel is obtained from the following equation:

$$I = \frac{C_{ox} \times \mu \times W}{L}(V_{DD} - \Delta V_{DD} - V_{data})^2 \quad (2)$$

in the above equations (1) and (2), $C_{ox}$ is a gate insulator (GI) parasitic capacitance of the thin-film transistor (TFT), μ is a migration rate of the TFT, W is width of a channel of the TFT, L is length of the channel of the TFT, $V_{DD}$ is a pixel driving voltage, $\Delta V_{DD}$ is a voltage drop, and, $V_{data}$ is a data voltage.

From the above equations, the current through the pixel is highly affected by change of the VDD. In order to minimize this affection as much as possible, the conventional solution is to minimize electric resistance existing in conductor of the transmission line as much as possible (e.g., to increase width and thickness of the conductor, to adopt a metal conductor with better electrical conductivity, etc.). However, even with such conventional solution, there still encounters the non-uniform signal transmission, even less obvious, thereby affecting the display effect.

SUMMARY OF THE INVENTION

At least one object of the present invention is to provide a display drive signal compensating method, which can compensate a voltage drop of the drive signal resulted by the transmission line internal resistance and thus improve the display effect thereof.

Another object of the present invention is to provide a display drive signal compensating device, which can compensate a voltage drop of the drive signal resulted by the transmission line internal resistance and thus improve the display effect.

Still another object of the present invention is to provide a display comprising a display drive signal compensating device, which can compensate a voltage drop of the drive signal resulted by the transmission line internal resistance and thus improve the display effect.

According to an embodiment of one aspect of the present invention, there is provided a display drive signal compensating method, comprising the steps of:

acquiring an original drive signal of every row of input pixels in a display;

determining a position of the row of input pixels, based on the original drive signal;

generating a compensation signal for compensating the original drive signal, based on a transmission line internal resistance at the position of the row of input pixels; and outputting a superposed signal obtained by superposing the compensation signal on the original drive signal to the row of input pixels.

According to an embodiment of a further aspect of the present invention, there is provided a display drive signal compensating device, comprising:

a data acquiring unit configured to acquire an original drive signal of every row of input pixels in a display;

a row-of-pixels position determining unit configured to determine a position of the row of input pixels, based on the original drive signal;

a compensation signal generating unit configured to generate a compensation signal for compensating the original drive signal, based on a transmission line internal resistance at the position of the row of input pixels; and a compensating unit configured to output a superposed signal obtained by superposing the compensation signal on the original drive signal to the row of input pixels.

According to an embodiment of a still further aspect of the present invention, there is provided a display comprising the abovementioned display drive signal compensating device.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
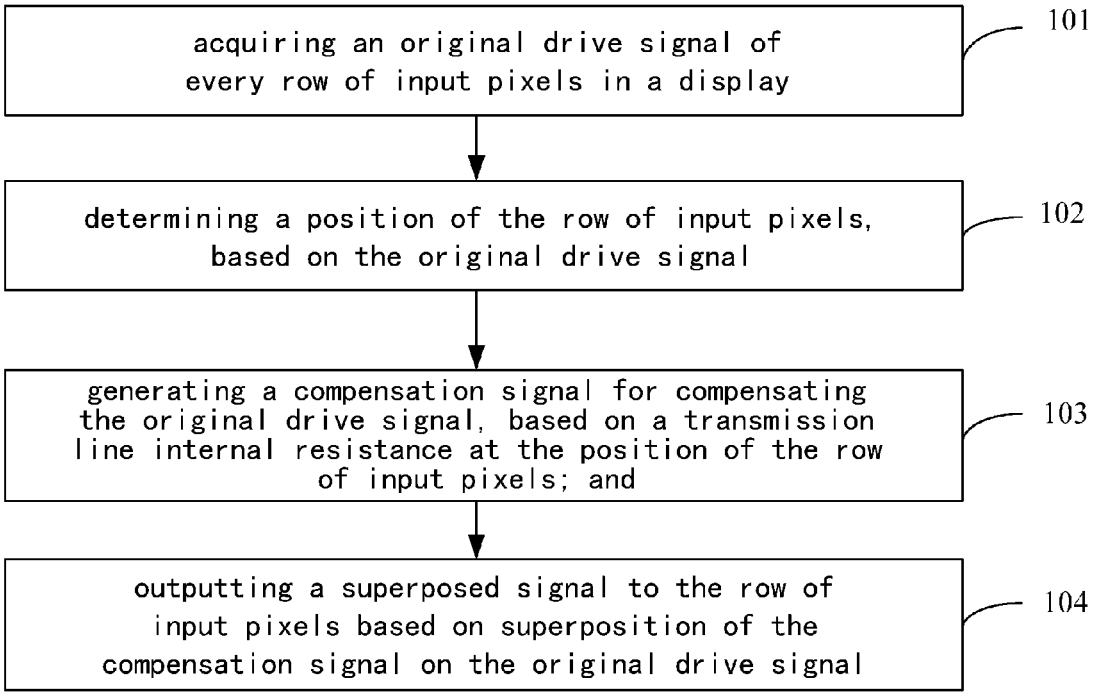
FIG. 1 is a flow chart of a display drive signal compensating method according to an embodiment of the present invention.

Exemplary embodiments of the present invention will be described hereinafter in detail with reference to the attached drawings, wherein the like reference numerals refer to the like elements. The present invention may, however, be embodied in many different forms and should not be construed as being limited to the embodiment set forth herein; rather, these embodiments are provided so that the present invention will be thorough and complete, and will fully convey the concept of the disclosure to those skilled in the art.

In accordance with a generally inventive concept of the present invention, referring to FIG. 1, there provides a display drive signal compensating method according to an embodiment of the present invention. This method comprises the steps of:

101). acquiring an original drive signal of every row of input pixels in a display;

102). determining a position of the row of input pixels, based on the original drive signal;

103). generating a compensation signal for compensating the original drive signal, based on a transmission line internal resistance at the position of the row of input pixels; and

104). outputting a superposed signal obtained by superposing of the compensation signal on the original drive signal to the row of input pixels.

Through the use of the display drive signal compensating method according to the embodiment of the present invention, the compensation signal for compensating the corresponding original drive signal of the row of input pixels is generated based on the transmission line internal resistance at the position of the row of input pixels, further, a superposed signal obtained by superposing of the compensation signal on the corresponding original drive signal of the row of input pixels is outputted to the row of input pixels, such that, the display effect is improved.

Figure 2:
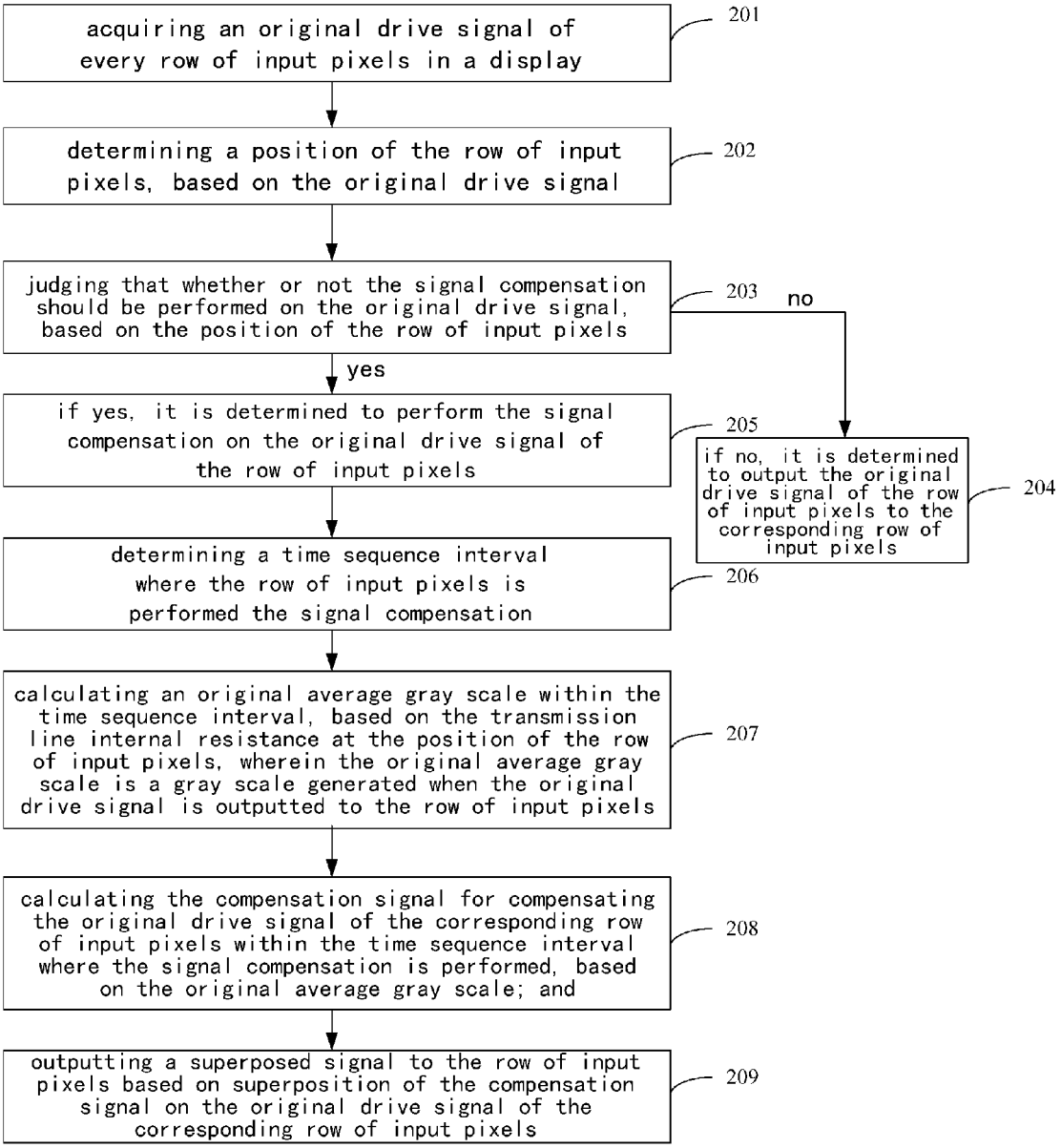
FIG. 2 is a flow chart of a display drive signal compensating method according to an alternative embodiment of the present invention.

Referring to FIG. 2, there provides a display drive signal compensating method according to an alternative embodiment of the present invention. This method comprises the steps of:

201). acquiring an original drive signal of every row of input pixels in a display;

202). determining a position of the row of input pixels, based on the original drive signal;

203). judging that whether or not the signal compensation should be performed on the original drive signal, based on the position of the row of input pixels;

204). if no, it is determined to output the original drive signal of the row of input pixels to the corresponding row of input pixels;

205). if yes, it is determined to perform the signal compensation on the original drive signal of the row of input pixels;

206). determining a time sequence interval where the row of input pixels is performed the signal compensation;

207). calculating an original average gray scale within the time sequence interval, based on the transmission line internal resistance at the position of the row of input pixels, wherein the original average gray scale is a gray scale generated when the original drive signal is outputted to the row of input pixels;

208). calculating the compensation signal for compensating the original drive signal of the corresponding row of input pixels within the time sequence interval where the signal compensation is performed, based on the original average gray scale; and

209). outputting a superposed signal to the row of input pixels based on superposition of the compensation signal on the original drive signal of the corresponding row of input pixels.

Figure 3:
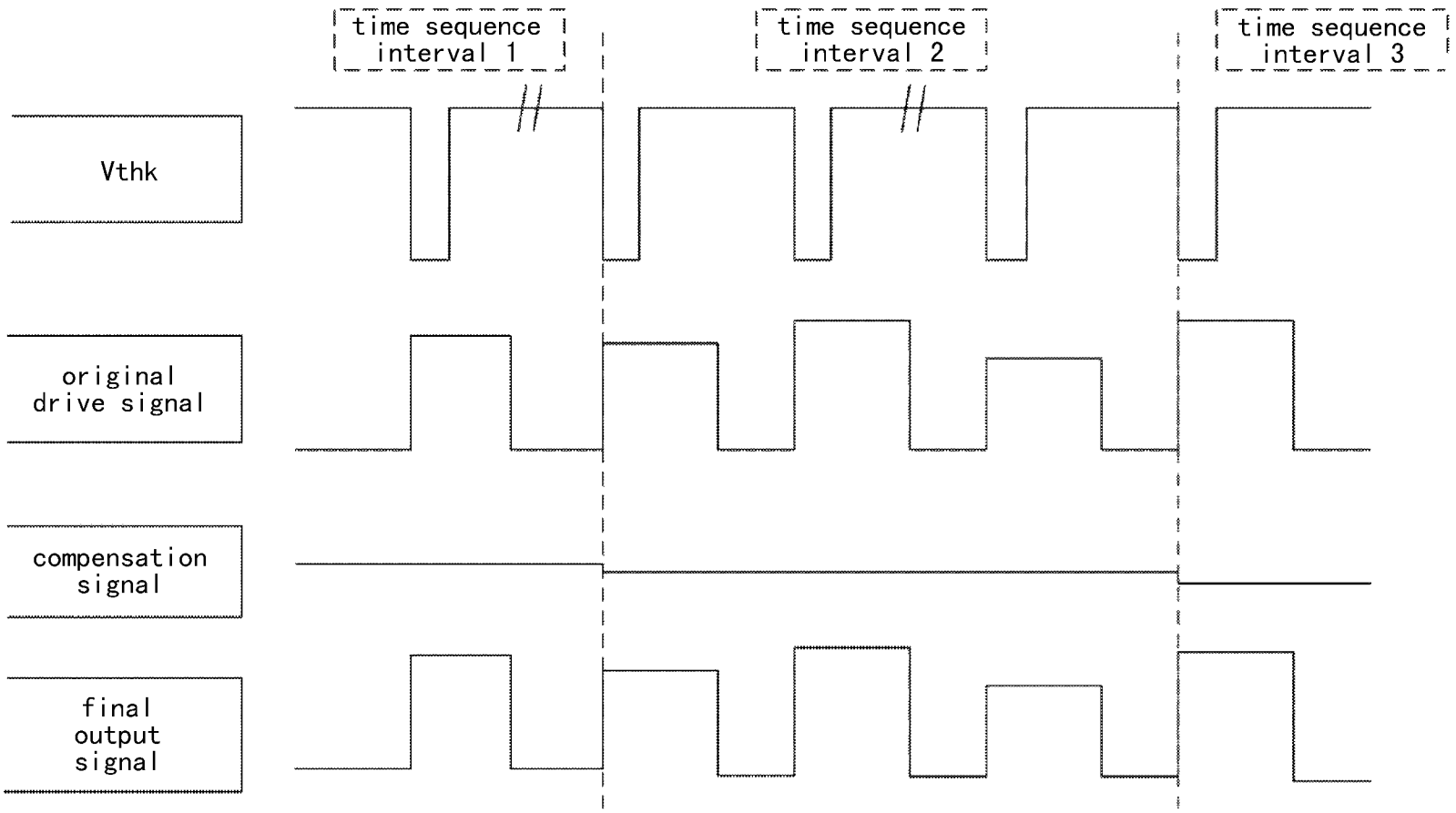
FIG. 3 is a time sequence chart of a compensation signal in the display drive signal compensating method according to the embodiment of FIG. 2.

A lookup table. 1 below and FIG. 3 show a distribution of a VDD voltage drop, due to a voltage drop in the transmission line, in respective typical gray scales (high brightness, middle brightness, low brightness), which is obtained by theoretical calculation. Since the voltage drop in the transmission line is in proportion to both the electrical current and the transmission line internal resistance, the latter is in proportion to a position of a corresponding row of the transmission line because the transmission line internal resistance is constant in a predetermined layout of the panel, accordingly, the voltage drop in the transmission line is only in proportion to the electrical current of the original drive signal.

Assumption that the panel is divided in accordance with tendency of the VDD voltage drop, there is no compensation for the rows from a first row to row P due to smaller size of the VDD voltage drop. The rest of these rows are equally divided (wherein thirty rows for one segment in Table 1). Data on the relationship between the VDD voltage drops of these positions in these segments and these average gray scales over these segments are added into a programmable logic device (PLD) for the drive signal compensating device according to the embodiment of the present invention, in order to generate a correspond compensating signal. The relationship is also shown in Table 1.

TABLE 1

| | typical gray scale segments | |
|---|---|---|
| positions | 127 | 130 |
| p~p + 30 | A | B |
| p + 31~p + 60 | C | D |
| p + 61~p + 90 | E | F |

Referring to Table 1, in the embodiment shown in FIGS. 2 and 3, the step 209 of superposition is explained as follows.

During the operation of the AMOLED panel, since there is a clock signal Vthk which is used to count the number of rows in a scanning of a row of input pixels, a negative potential signal is superposed on the normal data signal once the time arrives in the clock signal Vthk for the corresponding row of input pixels which is required to compensate. Further, in accordance with the brightness of these precious segments and the position in current segment, size of the negative potential signal can be found in Table 1.

The current through the pixel is obtained from the following equation:

$$I = \frac{C_{ox} \times \mu \times W}{L}(V_{DD} - \Delta V_{DD} - V_{data} + \Delta V_{data})^2 \quad (3)$$

In the above equation (3), $C_{ox}$ is a gate insulator (GI) parasitic capacitance of the thin-film transistor (TFT), μ is a migration rate of the TFT, W is width of a channel of the TFT, L is length of the channel of the TFT, $V_{DD}$ is a pixel driving voltage, $\Delta V_{DD}$ is a voltage drop, and, $V_{data}$ is a data voltage.

Therefore, compared with the prior art, the current obtained from the above equation (3) is much closer to the desirable current.

When the count in Vthk is beyond the boundary of a compensation segment and goes to a next compensation segment, a compensation signal for this next compensation segment can be obtained by calculation based on these in the table. In particular, the compensation signal is specifically a voltage value (for example, any one of A, B, C, D, E, F in Table 1 may be the compensation voltage value).

Figure 4:
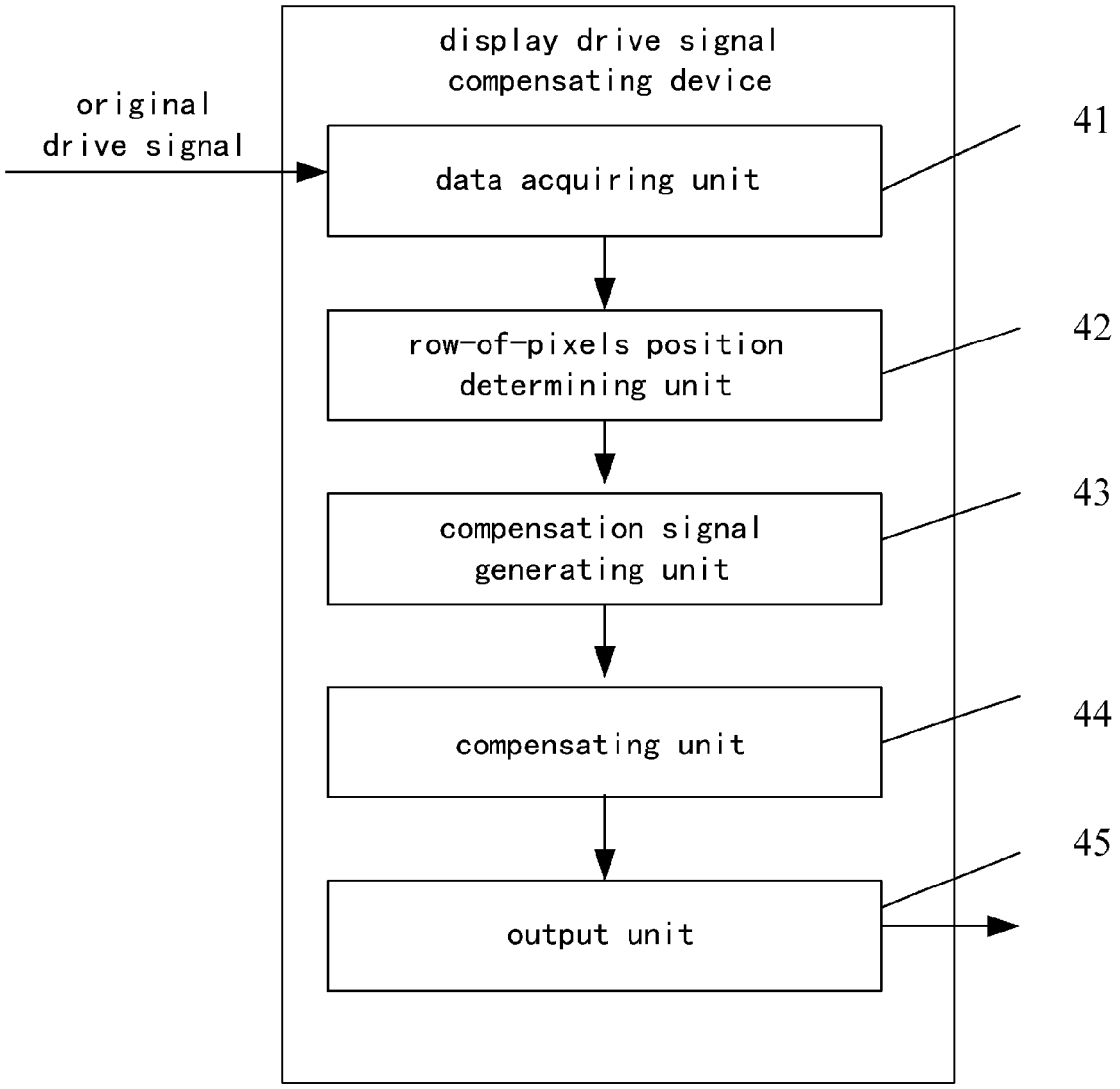
FIG. 4 is a schematic diagram of a display drive signal compensating device according to an embodiment of the present invention.

Referring to FIG. 4, there provides a display drive signal compensating device according to an embodiment of the present invention. This device comprises:

a data acquiring unit 41 configured to acquire an original drive signal of every row of input pixels in a display;

a row-of-pixels position determining unit 42 configured to determine a position of the row of input pixels, based on the original drive signal;

a compensation signal generating unit 43 configured to generate a compensation signal for compensating the original drive signal, based on a transmission line internal resistance at the position of the row of input pixels; and a compensating unit 44 configured to output through an output unit 45 to the row of input pixels a superposed signal obtained by superposing the compensation signal on the original drive signal.

Figure 5:
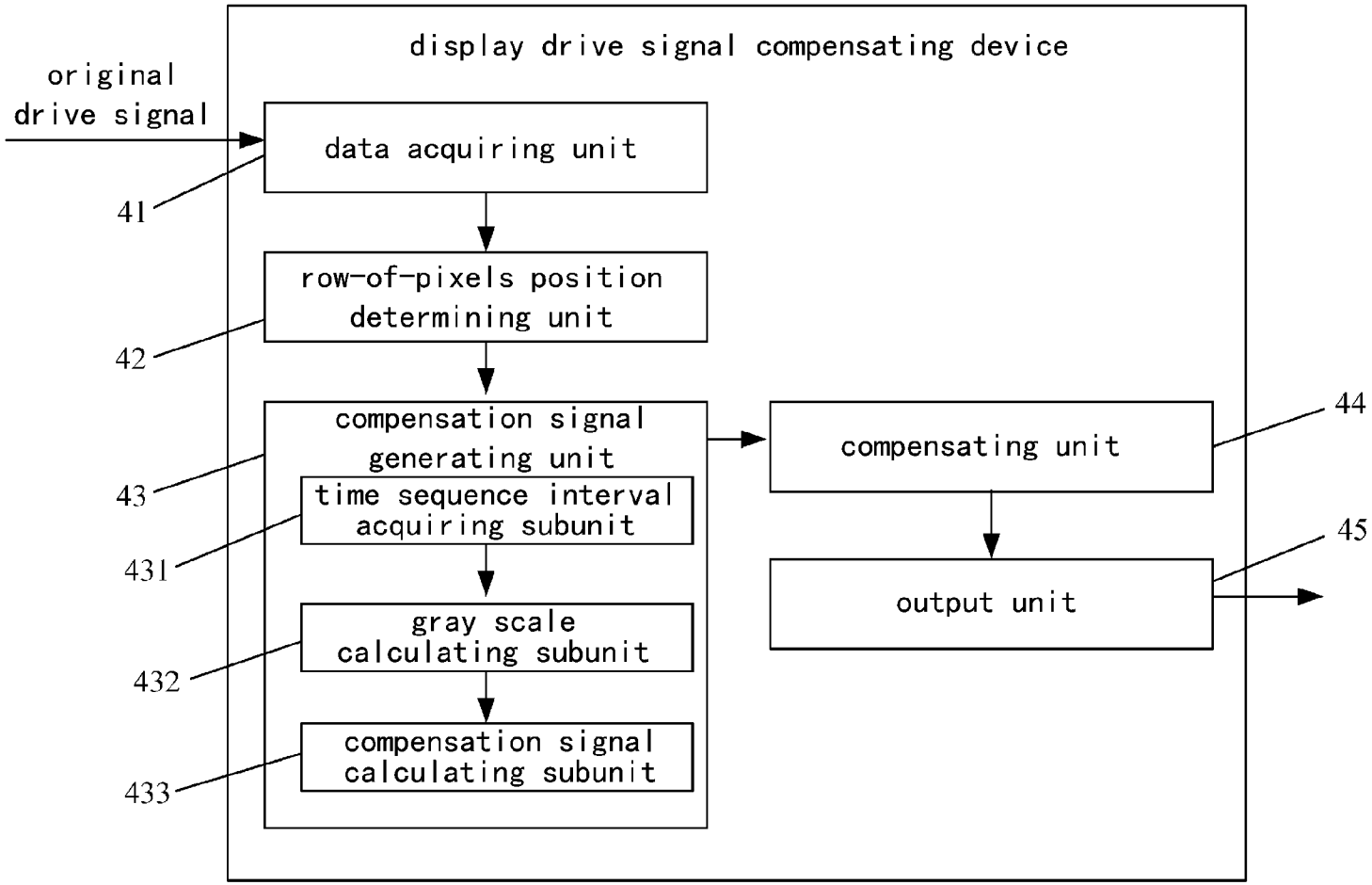
FIG. 5 is a schematic diagram of a display drive signal compensating device according to an alternative embodiment of the present invention.

Alternatively, referring to FIG. 5, this compensation signal generating unit 43 may further comprise:

a time sequence interval acquiring subunit 431 configured to determine a time sequence interval where the row of input pixels is performed the signal compensation;

a gray scale calculating subunit 432 configured to calculate an original average gray scale within the time sequence interval, based on the transmission line internal resistance at the position of the row of input pixels, wherein the original average gray scale is a gray scale generated when the original drive signal is outputted to the row of input pixels; and a compensation signal calculating subunit 433 configured to calculate the compensation signal based on the original average gray scale.

Figure 6:
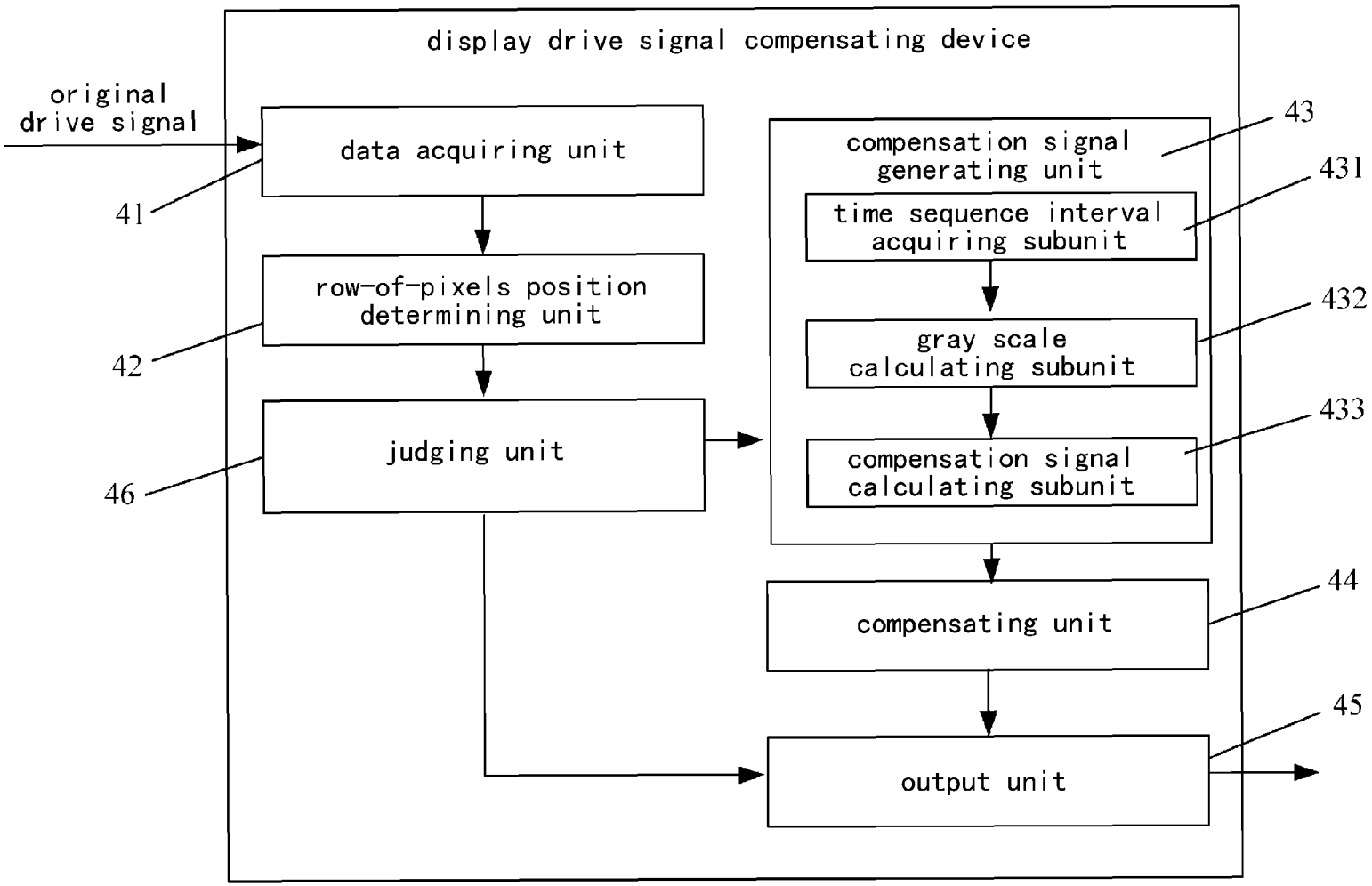
FIG. 6 is a schematic diagram of a display drive signal compensating device according to another alternative embodiment of the present invention.

Alternatively, referring to FIG. 6, this display drive signal compensating device may further comprise a judging unit 46 configured to judging that whether or not the signal compensation should be performed on the original drive signal of the row of input pixels, based on the position of the row of input pixels;

if yes, it is determined by the judging unit 46 to perform the signal compensation on the original drive signal of the row of input pixels; and if no, it is determined by the judging unit 46 to output the original drive signal by the output unit 45 to the corresponding row of input pixels.

Through the use of the display drive signal compensating device according to the embodiment of the present invention, the compensation signal for compensating the corresponding original drive signal of the row of input pixels is generated based on the transmission line internal resistance at the position of the row of input pixels, further, a superposed signal obtained by superposing the compensation signal on the corresponding original drive signal of the row of input pixels is outputted to the row of input pixels, so that a voltage drop of the original drive signal caused by the transmission line internal resistance is compensated, such that, the display effect is improved.

According to an embodiment of the present invention, there provides a display comprising an abovementioned display drive signal compensating device. This display may be the one used in the display equipments such as electronic paper, mobile phone, TV, digital photo frame, etc.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A display drive signal compensating method, comprising the steps of:

acquiring an original drive signal of each row of input pixels in a display;

determining a position of said row of input pixels, based on said original drive signal;

generating a compensation signal for compensating said original drive signal, based on a transmission line internal resistance at the position of said row of input pixels; and outputting a superposed signal obtained by superposing said compensation signal on said original drive signal to the row of input pixels;

wherein said step of generating the compensation signal further comprises the steps of:

determining a time sequence interval where said row of input pixels performs the signal compensation;

calculating an original average gray scale within said time sequence interval, based on said transmission line internal resistance at the position of said row of input pixels, wherein said original average gray scale is a gray scale generated when said original drive signal is outputted to said row of input pixels; and calculating said compensation signal based on said original average gray scale;

wherein calculating the original average gray scale within said time sequence interval, and calculating said compensation signal based on said original average gray scale, comprise:

accessing a lookup table that stores compensation signal values for positions of rows of input pixels and corresponding original average gray scale values; and wherein a current through the row of input pixels is obtained from an equation:

$$I = \frac{C_{ox} \times \mu \times W}{L}(V_{DD} - \Delta V_{DD} - V_{data} + \Delta V_{data})^2,$$

wherein:

$C_{OX}$ is a gate insulator (GI) parasitic capacitance of a thin-film transistor (TFT), μ is a migration rate of the TFT, W is a width of a channel of the TFT, L is a length of the channel of the TFT, $V_{DD}$ is a pixel driving voltage, $\Delta V_{DD}$ is a voltage drop, and $V_{data}$ is a data voltage.

2. The method according to claim 1, wherein prior to said step of generating the compensation signal, it further comprises the steps of:

judging whether or not the signal compensation is performed on said original drive signal, based on the position of said row of input pixels;

for first selected positions of said row of input pixels, it is determined to perform the signal compensation on said original drive signal; and for second selected positions of said row of input pixels, it is determined to output said original drive signal to the corresponding row of input pixels.

3. A display drive signal compensating device, comprising a memory and a processor in communication with the memory, wherein the processor is configured to execute:

a process to acquire an original drive signal of each row of input pixels in a display;

a process to determine a position of said row of input pixels based on said original drive signal, for each row of input pixels;

a process to generate a compensation signal for compensating said original drive signal, based on a transmission line internal resistance at the position of said row of input pixels; and a process to output a superposed signal obtained by superposing said compensation signal on said original drive signal to the row of input pixels;

wherein said process to generate a compensation signal further comprises:

a sub-process to determine a time sequence interval where said row of input pixels performs the signal compensation;

a sub-process to calculate an original average gray scale within said time sequence interval, based on said transmission line interval resistance at the position of said row of input pixels, wherein said original average gray scale is a gray scale generated when said original drive signal is outputted to said row of input pixels; and a sub-process to calculate said compensation signal based on said original average gray scale; and wherein the sub-process to calculate the original average gray scale within said time sequence interval, and the sub-process to calculate said compensation signal based on said original average gray scale, comprise:

accessing a lookup table that stores compensation signal values for positions of rows of input pixels and corresponding original average gray scale values; and wherein a current through the row of input pixels is obtained from an equation:

$$I = \frac{C_{ox} \times \mu \times W}{L}(V_{DD} - \Delta V_{DD} - V_{data} + \Delta V_{data})^2,$$

wherein:

$C_{OX}$ gate insulator (GI) parasitic capacitance of a thin-film transistor (TFT), μ is a migration rate of the TFT, W is width of a channel of the TFT, L is length of the channel of the TFT, $V_{DD}$ is a pixel driving voltage, $\Delta V_{DD}$ is a voltage drop, and $V_{data}$ is a data voltage.

4. The device according to claim 3, further comprising:

a process to judging whether or not the signal compensation is performed on said original drive signal, based on the position of said row of input pixels;

for first selected positions of said row of input pixels, it is determined to perform the signal compensation on said original drive signal; and for second selected positions of said row of input pixels, it is determined to output said original drive signal to the corresponding row of input pixels.

5. A display, comprising a display drive signal compensating device according to claim claim 3.

6. The method according to claim 1, wherein the lookup table groups the rows of input pixels in the display into regions.

7. The device according to claim 3, wherein the lookup table groups the rows of input pixels in the display into regions.

* * * * *